United States Patent [19]

Dziubaty

[11] 4,293,900

[45] Oct. 6, 1981

[54] LUMINAIRE REFLECTOR

[75] Inventor: Theodore D. Dziubaty, Gibsonia, Pa.

[73] Assignee: Forum, Inc., Pittsburgh, Pa.

[21] Appl. No.: 82,577

[22] Filed: Oct. 9, 1979

[51] Int. Cl.[3] ..... F21V 7/00

[52] U.S. Cl. ..... 362/342; 362/346; 362/348

[58] Field of Search ..... 362/342, 346, 348

[56] References Cited

U.S. PATENT DOCUMENTS 2,089,610 8/1937 Kloos ..... 362/348

*Primary Examiner*—Stephen J. Lechert, Jr.

*Attorney, Agent, or Firm*—Carothers and Carothers

[57] ABSTRACT

A bowl-type luminaire reflector having a series of reflector segments which in turn consist of a stepped vertical series of reflector sections which are prefocused to direct light in predetermined zones. The reflector sections have inwardly-convex curvature in the horizontal direction.

15 Claims, 9 Drawing Figures

LUMINAIRE REFLECTOR

BACKGROUND OF THE INVENTION

1. Field of the Invention

The present invention relates to luminaires and more particularly to luminaire reflectors to be used with high intensity light sources.

2. Description of the Prior Art

The present invention relates to bowl-type reflectors for use with high intensity light sources. A typical bowl-type luminaire of the prior art is illustrated in U.S. Pat. No. 3,950,638 which issued on Apr. 13, 1976 for High Intensity Indirect Lighting Fixture. Such luminaire reflectors are utilized with high intensity discharge lamps such as high pressure sodium lamps.

The object of such reflectors is to attempt to optically control light reflections and distribution to increase efficiency to a maximum and to prevent introduction of significant glare.

Such luminaires are generally utilized in schools, offices, shops, etc., for indirect lighting. In order to provide acceptable uniformity of lumination across the ceiling, it is desirable to achieve a light distribution from the luminaire which is generally referred to in the industry as a bat-wing distribution. It is a further object in the industry to achieve such a distribution with a luminaire which has very high efficiency.

However, a significant problem with luminaire reflectors of the prior art is that in order to obtain the highest efficiency, it is necessary to use a clear lamp as opposed to a phosphor lamp, and when such high intensity clear discharge lamps are utilized in reflectors of the prior art, the reflectors do not produce a smooth or uniform light distribution. It is further obvious that it is desirable in the interest of obtaining high efficiencies to use highly polished reflectors. Here again, with the luminaires of the prior art, undesirable light distribution is produced when the combination of a clear lamp and highly polished reflectors are utilized. The reflectors of the prior art produce ununiform illumination or light distribution with hot spots, strips and striations. Thus, in order to hide these deficiencies, many of the manufacturers of prior art luminaires use unpolished reflectors and phosphor-coated discharge lamps. The result, of course, is that the overall efficiency of the luminaire is greatly reduced.

It is a principal object of the present invention to provide a luminaire for high intensity discharge lamps which is void of the aforementioned disadvantages, and may be utilized with a clear lamp and highly polished reflector surfaces and still achieve uniform illumination and light distribution without offensive reflected light patterns with an overall efficiency of over 77%.

SUMMARY OF THE INVENTION

The luminaire reflector of the present invention generally comprises a side-by-side series of vertically-curved reflector segments which form in combination at least a larger segment, if not an entire, bowl-like reflector with reflective surfaces on the inside thereof. The mouth at the upper end of the reflector forms the largest diameter of the bowl-like reflector. Each of these reflector segments consists of a stepped vertical series of reflector sections which are pre-focused to direct light coming from a source within the reflector out over the mouth thereof into a predetermined radiation zone or zones. These reflector sections have reverse curvature, or in other words, have inwardly-convex curvature in the horizontal direction.

The result is that practically 100% of the light is collected and redirected without random scattering.

In its most efficient form, each of these reflector sections has compound curvature in the form of inwardly-vertical-concave curvature in conjunction with the aforesaid inwardly-horizontal-convex curvature. The preferred vertical-concave curvature is parabolic for as such, the reflector sections will reflect the light into the desired zone of radiation in substantially parallel rays. The preferred reverse curvature of the reflector sections or the aforesaid horizontal-convex curvature thereof is circular.

The preferred overall mean vertical curvature of each of the reflector segments is also parabolic. This further assists in pre-focusing the reflector sections of the reflector segment to obtain the desired redirection of the light into the predetermined light distribution zone or zones.

The reflector sections are further preferably pre-focused to reflect light out over the mouth of the reflector with maximum candle power appearing at about 15° above the horizontal.

The luminaire reflector of the present invention may be integrally molded or formed of a reflective plastic or a highly polished metal, or the reflector segments may be formed independently and then mechanically joined in a side-by-side series. In one embodiment, the reflector segments are formed independently of hydro-formed aluminum.

The luminaire reflector of the present invention most practically contain six to eight of the aforesaid reflector sections in each of the reflector segments. If an entire bowl-like reflector is formed as opposed to a segment thereof, it will generally include eleven to sixteen of the aforesaid reflector segments.

The reflector may also include a light aperture in the bottom thereof for direct lighting to objects thereunder as opposed to indirect lighting. In this regard, it should also be remembered that the reflector may be used in any attitude and in most any situation. It may be built into furniture or it may be made portable. It may be ceiling mounted or floor mounted. It may also be used upside down or rightside up as described. Also, a plurality of high intensity lamps may be utilized within one reflector.

The vertical-parabolic curvature of each of the reflector sections is utilized to reflect and redirect the light in substantially parallel rays into the desired zones, and the reverse curvature of the reflector section is utilized to distribute the reflected light uniformly in the horizontal direction and minimizes reflection of light back to the source, or in other words, reflects the light past obstacles within the reflector such as the lamp, lamp socket cover and stem components with uniformity.

BRIEF DESCRIPTION OF THE DRAWINGS

Other objects and advantages appear in the following description and claims.

The accompanying drawings show, for the purpose of exemplification without limiting the invention or the claims thereto, certain practical embodiments illustrating the principles of this invention wherein:

DESCRIPTION OF THE PREFERRED EMBODIMENTS

Figure 1:
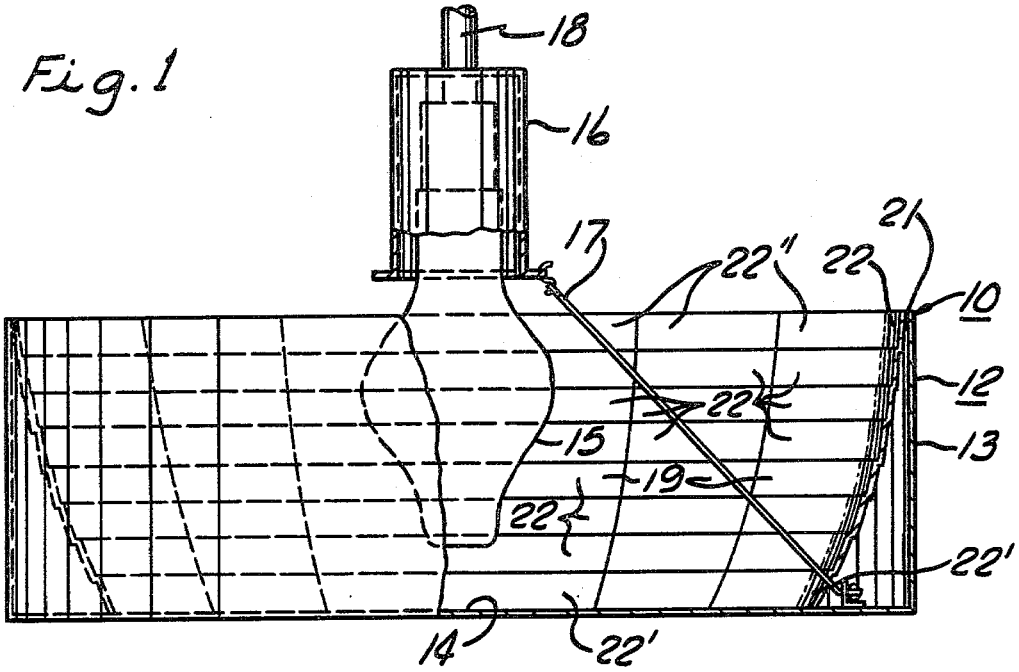
FIG. 1 is a view in side elevation, partially in cross section, of the luminaire reflector of the present invention.
Figure 2:
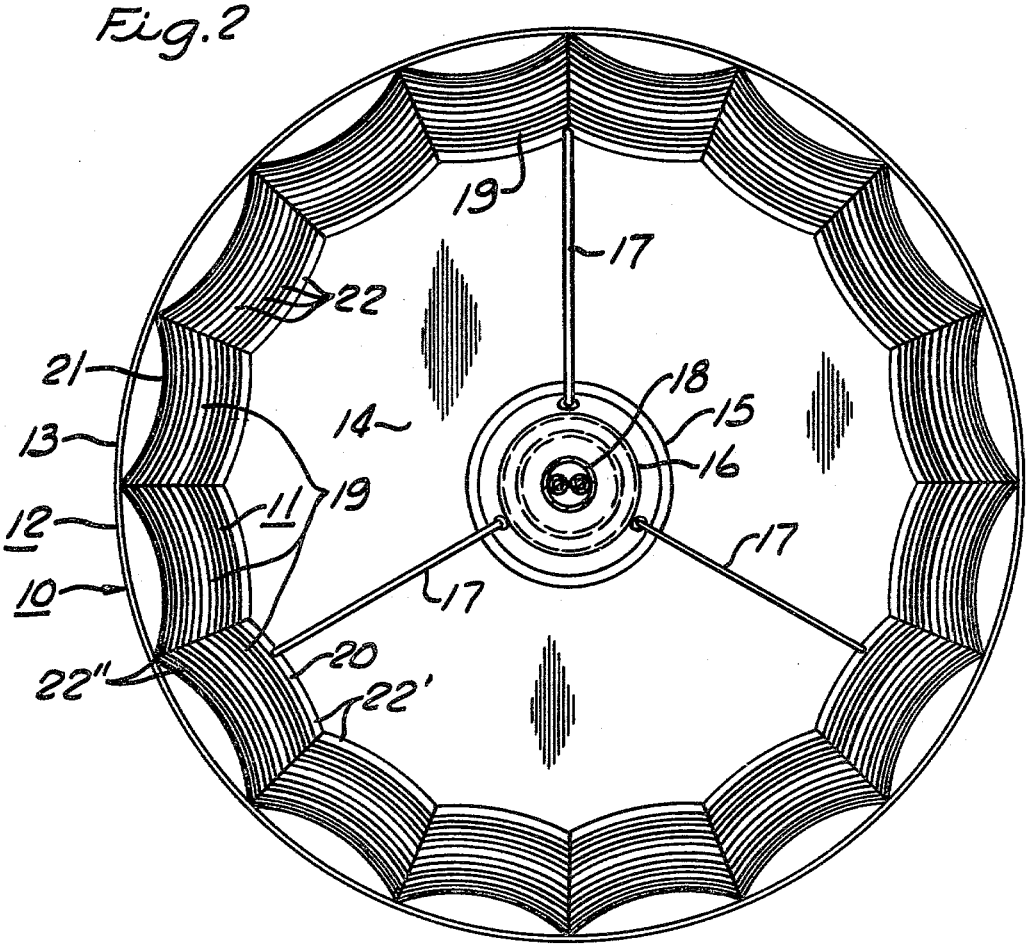
FIG. 2 is a top plan view of the luminaire reflector shown in FIG. 1.

Referring to FIGS. 1 and 2, luminaire 10 of the present invention is generally comprised of a bowl-like reflector 11 housed within cylindrical luminaire housing 12 having a cylindrical side wall 13 and a circular flat bottom 14. High intensity discharge lamp 15 is secured in a conventional manner in an electrical socket housed within socket cover 16. Reflector 11 and luminaire housing 12 are in turn suspended from socket cover 16 by means of spokes 17. Socket cover 16 is, in turn, suspended from a ceiling by means of conduit 18 which also houses the electrical conductors for energization of lamp 15.

The reflector 11 comprises a side-by-side series of vertically-curved reflector segments 19 which form in combination the entire bowl-like reflector 11. It should be borne in mind, that one might not necessarily always utilize an entire bowl-like reflector which encompasses 360°. In some lighting situations, it may be desirable to use, for example, only a half of the reflector, or 180°, or a quarter reflector, which extends only 90°. Thus, any segment of the entire bowl-like reflector 11 can be utilized. The inside reflective surfaces 20 of bowl-like reflector 11 are highly polished.

The mouth 21 at the upper end of the reflector forms the largest diameter thereof and provides the opening through or over which the light is directed out of the top of the luminaire.

Figure 7:
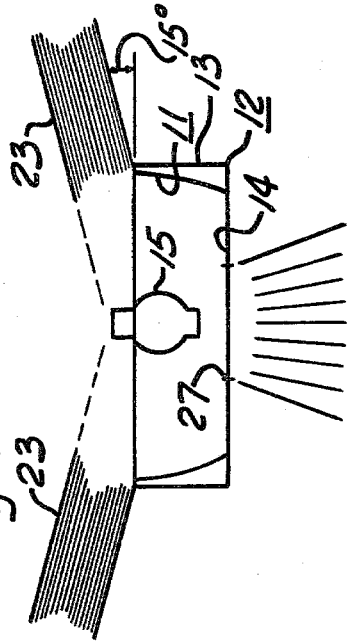
FIG. 7 is a diagrammatic view in side elevation of the reflector of the present invention illustrated with an additional bottom light aperture.

Each of these reflector segments 19 consists of a stepped vertical series of reflector sections 22 which are pre-focused to direct light coming from source or lamp 15 out over mouth 21 into a predetermined radiation zone. This radiation zone 23 is schematically illustrated in FIG. 7. Each of these reflector sections 22 have a reverse curvature or an inwardly-convex curvature in the horizontal direction. This reverse curvature horizontally distributes the light in the radiation zone with uniformity and prevents the reflected light from being reflected directly back to the source or lamp 15. This light is thus reflected past socket cover 16, lamp 15 and conduit 18. This reverse curvature creates a very uniform horizontal distribution of the reflective light without glare, hot spots, strips or striations.

Each of these reflector sections 22 actually have a compound curvature in the form of an inwardly-vertical-concave curvature best seen in FIG. 1 in conjunction with the aforesaid inwardly-horizontal-convex curvature best illustrated in FIG. 2. This vertical-concave curvature of each reflector section is parabolic. This vertical-parabolic curvature of each pre-focused section 22 permits all the light to be reflected and redirected in substantially parallel rays concentrated within the predetermined radiation zone diagrammatically illustrated at 23 in FIG. 7. Thus, practically 100% of the light is collected and actually directed in parallel rays within the desired or predetermined zone of radiation or distribution. The use of this parabolic curve for each reflector section permits accurate redirection of the reflected light into substantially parallel rays which would not otherwise be possible with other curvatures such as eliptical or circular.

The horizontal-reverse curvature or convex curvature of these reflector sections is circular, as this provides the most even distribution.

In addition, the overall mean vertical curvature of each of these reflector sections 22 is also parabolic to again assist in pre-focusing the reflector sections 22 such that the rays of light are redirected properly into the predetermined radiation zone in parallel rays. The reflector sections 22 are pre-focused such that the reflector sections 22′ at the very bottom of the reflector 11 will be reflected to just clear over the edge or mouth 21 of the luminaire. Thus, the focus of the bottom reflector sections 22′ and the upper reflector sections 22″ determine the upper and lower limits of the desired radiation zone 23 illustrated in FIG. 7. All rays in between these upper and lower limits are reflected in substantially parallel alignment due to the pre-focusing of the reflector sections 22 in between top and bottom reflector sections 22″ and 22′.

Figure 3:
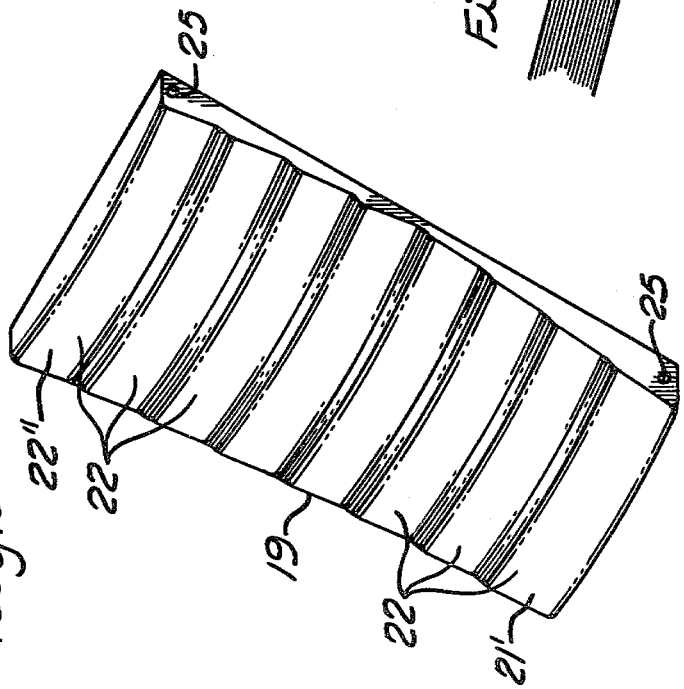
FIG. 3 is a perspective view of one hydro-formed aluminum reflector segment utilized in the reflector of the present invention.

Reflector 11 may be integrally molded or formed of metal or plastic which is highly reflective, or each reflector segment 19 may be individually molded or formed. FIG. 3 shows one of the reflector segments which has been independently made from hydro-formed aluminum over a mold. These aluminum reflector segments 19 are joined side-by-side mechanically by means of pop rivets or the like through side openings 25. Any number of these segments 19 may be joined to make an entire 360° reflector, or some segment portion thereof. Most practically, eleven to sixteen reflector segments 19 will be utilized to form a complete 360° bowl-like reflector. As a practical matter also, generally six to eight of the reflector sections 22 will be provided in each reflector segment.

Figure 5:
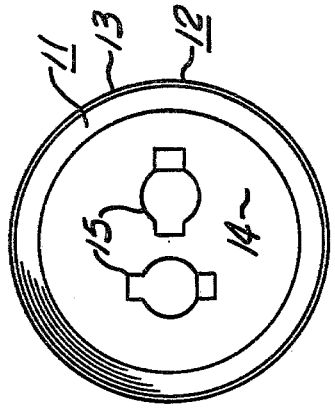
FIG. 5 is a diagrammatic plan view of the reflector of the present invention illustrating the use of two high intensity lamps in a T-configuration.
Figure 4:
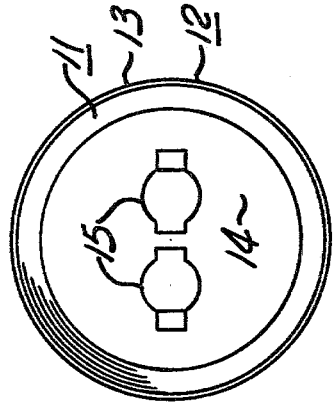
FIG. 4 is a diagrammatic plan view of the reflector of the present invention utilizing two high intensity lamps in straight opposed alignment.
Figure 6:
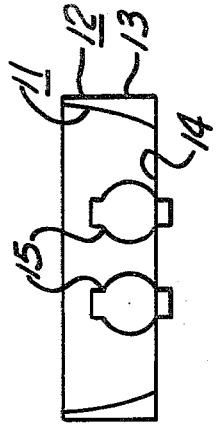
FIG. 6 is a diagrammatic view in side elevation illustrating the reflector of the present invention with two high intensity lamps positioned in vertical parallel alignment.

Referring next to FIGS. 4, 5 and 6, these Figures merely diagrammatically illustrate that plural high intensity lamps may be utilized with the reflector of the present invention. FIG. 4 illustrates the use of two lamps 15 in straight line opposition horizontally positioned within the luminaire of the present invention. FIG. 5 illustrates the use of two lamps, but in this embodiment, the lamps 15 are arranged in a horizontal T-configuration. FIG. 6 illustrates the use of two lamps in vertical parallel alignment.

Referring next to FIG. 7, as previously explained, FIG. 7 diagrammatically illustrates the predetermined zones or zone of light radiation. This zone 23, of course, is annular, or runs for 360° about the luminaire. FIG. 7 also illustrates the use of a bottom light aperture 27 which is installed in bottom 14 of the luminaire housing for situations wherein a small amount of direct lighting to an underlying object is required in addition to the indirect lighting. As previously explained, the luminaire of the present invention can actually be used in any attitude. For example, it may be inverted from the position illustrated in the drawings.

Figure 8:
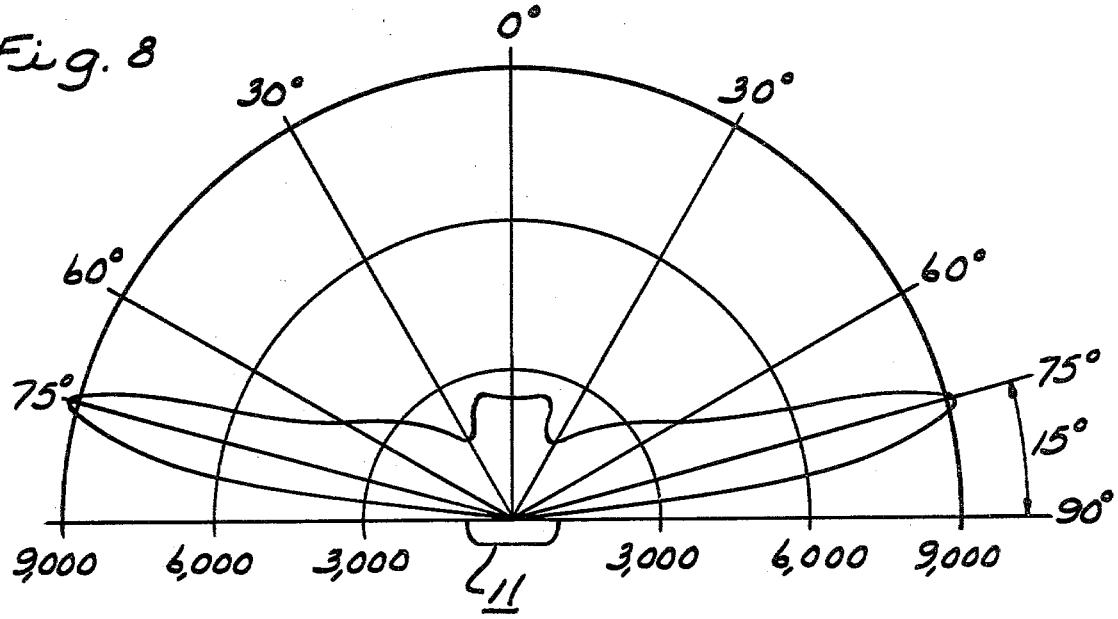
FIG. 8 is a candle power distribution curve illustrating distribution from a 400-watt clear high intensity metal halide lamp disposed within the reflector of the present invention with the inside bottom portion of the optical assembly finished in black.
Figure 9:
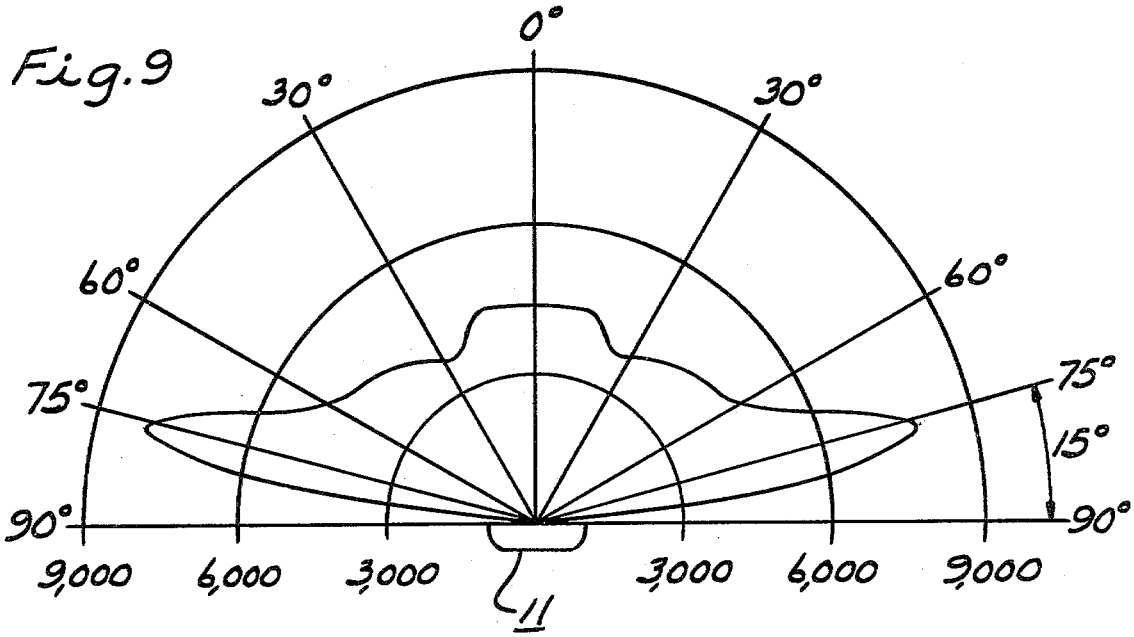
FIG. 9 is another candle power distribution curve in which a clear 400-watt high intensity discharge lamp is disposed within the same fixture used in FIG. 8 wherein the inside bottom portion of the optical assembly is painted white.

Turning next to FIGS. 8 and 9, these candle power distribution curves illustrate the distribution of light made from actual tests of the luminaire of the present invention wherein measurements were made at various points around the lamp and the curve represents constant luminosity on the radius. Both of these tests were made with a 400-watt clear metal halide lamp rated at 34,000 lumens and the luminaire was mounted in pendant fashion. In the test of FIG. 8, the bottom 14 of the housing was painted black, and in the test of FIG. 9, the bottom portion of the housing 14 was painted white. As can be seen in both instances, the reflector sections 22 are pre-focused to reflect light over mouth 21 with maximum candle power at about 15° above the horizontal. This is preferable, as this horizontally distributes the reflected light to a maximum thereby providing maximum illumination of the ceiling without actually directly bouncing the radiation off side walls.

The illumination was found to be extremely uniform with no production of hot spots, strips, or striations, even though a clear light source was utilized and the reflector surfaces were highly polished. Efficiencies in excess of 77% were obtained. Significant glare was also eliminated.

I claim:

1. A luminaire reflector comprising a side-by-side series of vertically-curved reflector segments forming in combination at least a larger segment of a bowl-like reflector with reflective surfaces on the inside thereof and having a mouth at its upper end which forms the largest diameter thereof, each of said reflector segments consisting of a stepped vertical series of reflector sections pre-focused to direct light coming from a source within the bowl-like reflector out over said mouth into a predetermined radiation zone, said reflector sections having inwardly-convex curvature in the horizontal direction.

2. The luminaire reflector of claim 1 wherein each of said reflector sections has compound curvature in the form of inwardly-vertical-concave curvature in conjunction with said inwardly-horizontal-convex curvature.

3. The luminaire reflector of claim 2 wherein said reflector section vertical-concave curvature is parabolic.

4. The luminaire reflector of claim 3 wherein said horizontal-convex curvature is circular.

5. The luminaire reflector of claim 1, 2, 3 or 4 wherein said reflector sections are pre-focused to reflect light into said zone in substantially parallel rays.

6. The luminaire reflector of claim 4 wherein the overall mean vertical curvature of said reflector segments is parabolic.

7. The luminaire reflector of claim 1, 2, 3 or 4 wherein said sections are pre-focused to reflect light out over said mouth with maximum candle power at about 15° above the horizontal.

8. The luminaire reflector of claim 1 wherein said reflector segments are formed of highly polished metal.

9. The luminaire reflector of claim 8 wherein said segments are hydro-formed aluminum.

10. The luminaire reflector of claim 1 wherein said bowl-like reflector is molded of plastic.

11. The luminaire reflector of claim 1 wherein there are six to eight of said reflector sections in each of said reflector segments.

12. The luminaire reflector of claim 1 wherein said reflector segments form an entire bowl-like reflector.

13. The luminaire reflector of claim 12 including eleven to sixteen of said reflector segments.

14. The luminaire reflector of claim 1 including a light aperture in the bottom of said bowl-like reflector.

15. The luminaire reflector of claim 1 including means to retain at least one light source within said bowl-like reflector.

* * * * *